US010597758B2

(12) United States Patent
Kim et al.

(10) Patent No.: US 10,597,758 B2
(45) Date of Patent: Mar. 24, 2020

(54) CEMENTED CARBIDE WITH IMPROVED TOUGHNESS

(71) Applicant: KORLOY INC., Seoul (KR)

(72) Inventors: Jung-wook Kim, Cheongju-si (KR); Sung-Gu Lee, Cheongju-si (KR); Yong-hyun Kim, Cheongju-si (KR); Sun-yong Ahn, Cheongju-si (KR)

(73) Assignee: KORLOY INC., Seoul (KR)

( * ) Notice: Subject to any disclaimer, the term of this patent is extended or adjusted under 35 U.S.C. 154(b) by 213 days.

(21) Appl. No.: 15/517,167

(22) PCT Filed: Nov. 10, 2015

(86) PCT No.: PCT/KR2015/012055
§ 371 (c)(1),
(2) Date: Apr. 6, 2017

(87) PCT Pub. No.: WO2016/108421
PCT Pub. Date: Jul. 7, 2016

(65) Prior Publication Data

US 2017/0306455 A1 Oct. 26, 2017

(30) Foreign Application Priority Data

Dec. 30, 2014 (KR) ..... 10-2014-0193111

(51) Int. Cl.
*C22C 29/08* (2006.01)
*C22C 19/07* (2006.01)
*C22C 29/02* (2006.01)

(52) U.S. Cl.
CPC ..... *C22C 29/08* (2013.01); *C22C 19/07* (2013.01); *C22C 29/02* (2013.01)

(58) Field of Classification Search
USPC ..... 428/325, 336, 698
See application file for complete search history.

(56) References Cited

U.S. PATENT DOCUMENTS 5,181,953 A * 1/1993 Nakano ..... C22C 29/08 75/242
6,057,046 A * 5/2000 Tsuda ..... B22F 7/02 428/698

(Continued)

FOREIGN PATENT DOCUMENTS

JP 2006-021316 A 1/2006
KR 10-2000-0057904 A 9/2000
KR 10-2005-0110822 A 11/2005

(Continued)

OTHER PUBLICATIONS

Larsson et. al. "X-ray diffraction determination of residual stresses in functionally graded WC-Co composites". International Journal of Refractory Metals & Hard Materials 22 (2004) p. 177-184 (Year: 2004).*

(Continued)

*Primary Examiner* — Archene A Turner
(74) *Attorney, Agent, or Firm* — Revolution IP, PLLC

(57) ABSTRACT

A cemented carbide comprises particles including a tungsten carbide (WC) as a main component; a binder phase including cobalt (Co) as a main component; and particles including a carbide or a carbonitride of at least one selected from the group consisting of Group 4a, 5a, and 6a elements, or a solid solution thereof, wherein a cubic phase free layer (CFL), in which the carbide or the carbonitride is not formed, is formed from a surface of the cemented carbide to a depth of 5 μm to 50 μm.

2 Claims, 1 Drawing Sheet

(56) References Cited

U.S. PATENT DOCUMENTS

| | | | | |
|---|---|---|---|---|
| 7,699,904 | B2 * | 4/2010 | Fang | B22F 7/02 75/240 |
| 8,394,169 | B2 * | 3/2013 | Heinrich | C22C 29/08 75/242 |
| 2002/0051871 | A1 | 5/2002 | Palmqvist et al. | |
| 2006/0019117 | A1 | 1/2006 | Cedergren et al. | |
| 2007/0292671 | A1 | 12/2007 | Akesson et al. | |
| 2011/0247465 | A1 | 10/2011 | Lind et al. | |

FOREIGN PATENT DOCUMENTS

| | | | |
|---|---|---|---|
| KR | 10-2009-0023383 | A | 3/2009 |
| KR | 10-2011-0100621 | A | 9/2011 |

OTHER PUBLICATIONS

Zhang et. al. "Experimental investigation and simulation of the effect of Ti and N contents on the formation of fcc-free surface layers in WC-Ti)C,N)-Co cemented carbides". . . International Journal of Refractory Metals & Hard Materials 41 (2013) p. 638-647. (Year: 2013).*

International Search Report for PCT/KR2015/012055 dated Feb. 11, 2016 from Korean Intellectual Property Office.

* cited by examiner

【FIG. 1】
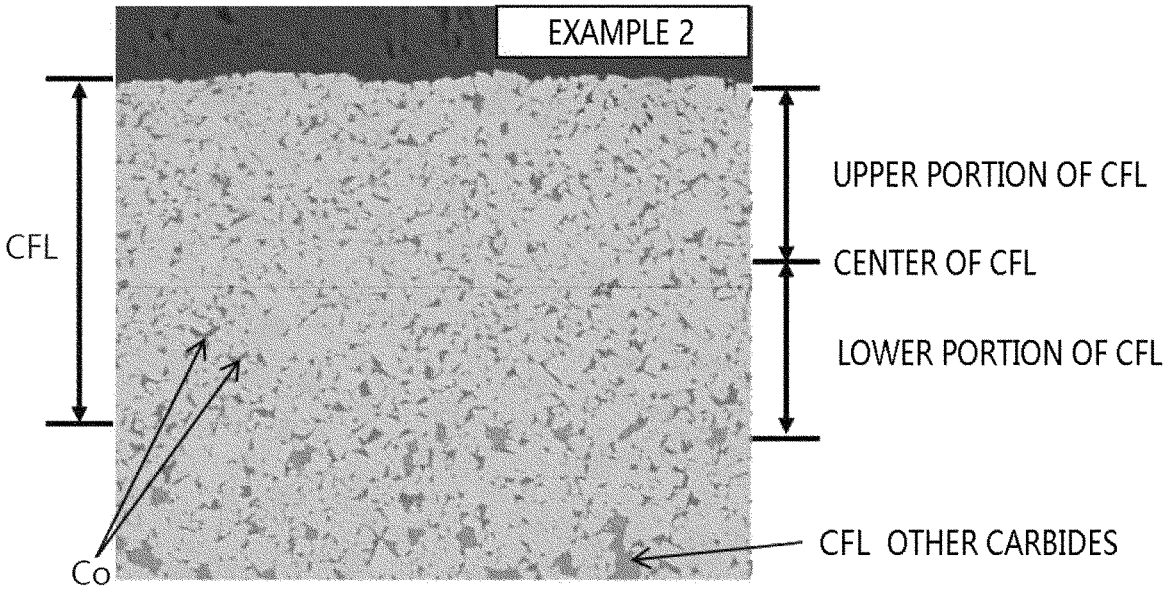
【FIG. 2】
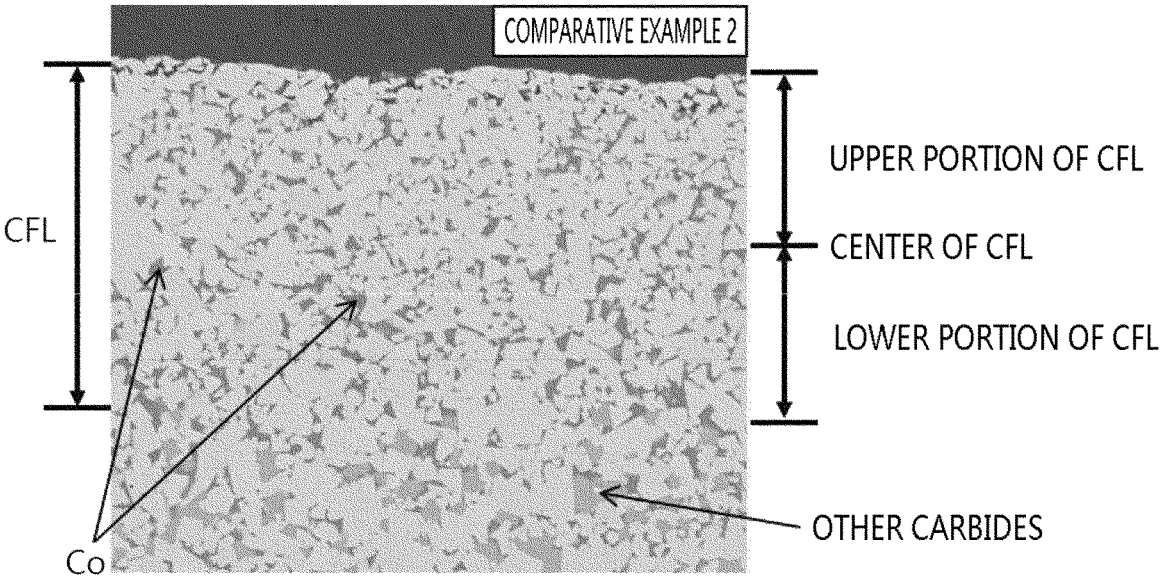

CEMENTED CARBIDE WITH IMPROVED TOUGHNESS

CROSS REFERENCE TO PRIOR APPLICATIONS

This application is a National Stage Application of PCT International Patent Application No. PCT/KR2015/012055 filed on Nov. 10, 2015, under 35 U.S.C. § 371, which claims priority to Korean Patent Application No. 10-2014-0193111 filed on Dec. 30, 2014, which are all hereby incorporated by reference in their entirety.

TECHNICAL FIELD

The present invention relates to a cemented carbide for a cutting tool, and more particularly, to a cemented carbide for a cutting tool suitable for high-speed feed and high-speed machining in which, even if a high-hardness film is formed on a cemented carbide base material, good impact resistance as well as excellent wear resistance may be obtained by suppressing the formation of an irregular coarse cobalt (Co) structure in a cubic phase free layer (CFL) formed in the cemented carbide as much as possible.

BACKGROUND ART

Cemented carbides for cutting tools, as composite materials of a WC hard phase and a cobalt (Co) binder metal phase, are representative dispersion alloys, wherein their mechanical properties depend on a particle diameter of the WC hard phase and an amount of the Co binder metal phase, hardness and toughness are particularly in an inversely proportional relationship to each other, properties required for the cemented carbides for cutting tools vary according to machining methods, and accordingly, various attempts have been made to control the mechanical properties of the cemented carbides.

Recently, in machining market, there is a growing demand for a shorter cycle time to improve competitiveness through cost reduction. In order to reduce the cycle time, since machining conditions are gradually changed to high-speed, high-feed conditions, there is an increasing need to allow physical properties of the corresponding cutting tool to have characteristics in which both wear resistance and toughness are good at the same time so that good machining may be performed even under the high-speed, high-feed conditions.

Accordingly, with respect to a hard coating formed on the cutting tool, a coating including an alpha-phase alumina layer, which has excellent stability at high temperature, has been preferred, and, with respect to a MT-TiCN layer formed as an underlayer of the alumina layer, a fine and uniform columnar structure has been preferred due to a trend towards high hardness.

In a case in which non-uniform plastic deformation occurs in a base material of the cutting tool, since chipping easily occurs in a high-hardness film formed on the base material, stability of base material characteristics in a direction perpendicular to the film is required to allow physical properties of the high-hardness film to be fully exhibited.

In a surface portion of the base material on which the hard film is formed, a toughness reinforcement layer (Cubic phase Free Layer, hereinafter, referred to as "CFL"), in which a cubic carbide constituting the base material is not present, is formed from a surface to a depth of about 10 μm to about 40 μm so as to absorb an impact generated during machining as disclosed in a patent document (Korean Patent Application Laid-open Publication No. 2005-0110822), wherein uniformity of the CFL (uniformity of microstructure by location, uniformity of composition by location) is required for the above-described high-hardness film.

However, with respect to a CFL of a current commercially available cemented carbide, there is a tendency that a Co structure toward a surface is small and an irregular coarse Co structure is formed as it moves to the inside of the CFL, and, since the irregularly formed coarse Co structure disturbs the uniformity of the CFL, it may be a cause of deteriorating overall physical properties of the cutting tool.

For this reason, as the current technological trends, development focusing on reducing a thickness of the CFL while using the high-hardness film are being conducted to improve wear resistance and plastic deformation resistance of the cutting tool. However, when the thickness of the CFL, which functions as the toughness reinforcement layer absorbing an external impact, is excessively decreased, the function of the CFL as an impact absorbing layer may be rapidly reduced to reduce the toughness of the cutting tool.

DISCLOSURE OF THE INVENTION

Technical Problem

The purpose of the present invention is to provide a cemented carbide having excellent wear resistance and impact resistance even if a high-hardness film is formed on a cemented carbide base material.

Technical Solution

According to an embodiment of the present invention, there is provided a cemented carbide which includes particles including a tungsten carbide (WC) as a main component, a binder phase including cobalt (Co) as a main component, and particles including a carbide or a carbonitride of at least one selected from the group consisting of Group 4a, 5a, and 6a elements, or a solid solution thereof, wherein a cubic phase free layer (CFL), in which the carbide or the carbonitride is not formed, is formed from a surface of the cemented carbide to a depth of 5 μm to 50 μm, and, when a portion from a center of the CFL to a surface of the CFL is referred to as an upper portion of the CFL, a portion from the center of the CFL to a boundary of a bottom of a base material is referred to as a lower portion of the CFL, and a length of a major axis of a Co structure, in which a ratio of the length of the major axis of the Co structure formed in the CFL to a length of a minor axis thereof is 5 or less, is referred to as a size of the Co structure, a size of a largest Co structure in the lower portion of the CFL is 2 times or less a size of a largest Co structure in the upper portion of the CFL.

According to the above configuration, non-uniformity of the Co structure according to a thickness of the CFL is significantly reduced by allowing a maximum size of the Co structure disposed at the lower portion based on the center of the CFL to be 2 times or less a maximum size of the Co structure disposed at the upper portion based on the center of the CFL (that is, uniformity of the Co structure in a thickness direction of the CFL is increased). Accordingly, since non-uniformity of the base material is reduced even if a high-hardness film is formed on the CFL, impact resistance as well as wear resistance of a cutting tool may be well maintained.

Advantageous Effects

Since a cemented carbide according to an embodiment of the invention may include a uniform cobalt (Co) structure in a cubic phase free layer (CFL), a thickness of the CFL may be maintained thick while a high-hardness film is formed on the cemented carbide. Thus, excellent wear resistance and impact resistance suitable for high-speed feed and high-speed machining may be provided.

BRIEF DESCRIPTION OF THE DRAWINGS

FIG. 1 is a micrograph of a cemented carbide according to Example 2 of the invention; and FIG. 2 is a micrograph of a cemented carbide according to Comparative Example 2 of the invention.

MODE FOR CARRYING OUT THE INVENTION

Hereinafter, embodiments of the invention will be described in detail with reference to the accompanying drawings. However, the invention may be embodied in many different forms and should not be construed as being limited to the embodiments set forth herein. Rather, these embodiments are provided so that this description will be thorough and complete, and will fully convey the scope of the invention to those skilled in the art.

In the invention, the expression "Cubic phase Free Layer (CFL)" denotes a surface region in which a binder phase is rich and a cubic carbide phase is absent from a surface of a base material composed of a cemented carbide sintered body to a predetermined depth.

Also, the expression "size of Co structure" denotes a length of a major axis of the Co structure excluding a Co structure, in which a ratio of a length of the longest major axis to a length of the shortest minor axis is greater than 5, among the Co structures observed in the CFL. Herein, the reason for the exclusion of the elongated Co structure, in which the ratio of the length of the major axis to the length of the minor axis is greater than 5, is to distinguish the Co structure from an irregular coarse Co structure having a great effect on physical properties of the CFL.

A cutting tool according to an embodiment of the invention includes a cemented carbide which includes particles including a tungsten carbide (WC) as a main component; a binder phase including cobalt (Co) as a main component; and particles including a carbide or a carbonitride of at least one selected from the group consisting of Group 4a, 5a, and 6a elements, or a solid solution thereof, wherein a cubic phase free layer (CFL), in which the carbide or the carbonitride is not formed, is formed from a surface of the cemented carbide to a depth of 5 μm to 50 μm, and, when a portion from a center of the CFL to a surface of the CFL is referred to as an upper portion of the CFL, a portion from the center of the CFL to a boundary of a bottom of a base material is referred to as a lower portion of the CFL, and a length of a major axis of a Co structure formed in the CFL is referred to as a size of the Co structure, a size of a largest Co structure in the lower portion of the CFL is 2 times or less a size of a largest Co structure in the upper portion of the CFL.

In a case in which a thickness of the CFL is less than 5 μm, the CFL hardly acts as a toughness reinforcement layer, and, in a case in which the thickness of the CFL is greater than 50 μm, wear resistance is rapidly reduced. Thus, the thickness of the CFL may be in a range of 5 μm to 50 μm, for example, 10 μm to 30 μm.

The cemented carbide, for example, may include 1.5 wt % to 20 wt % of the carbide or the carbonitride including at least one of tantalum (Ta), niobium (Nb), and titanium (Ti), 4 wt % to 10 wt % of the Co, and the WC as well as unavoidable impurities as a remainder. In a case in which an amount of the carbide or the carbonitride is less than 1.5 wt %, wear resistance is rapidly reduced, and, in a case in which the amount of the carbide or the carbonitride is greater than 20 wt %, welding resistance and chipping resistance are rapidly reduced. Thus, the amount of the carbide or the carbonitride may be in a range of 1.5 wt % to 20 wt %. Also, in a case in which an amount of the Co is less than 4 wt %, since the binder phase is insufficient, a binding force between WC particles is weak to reduce the chipping resistance, and, in a case in which the amount of the Co is greater than 10 wt %, since the binder phase is excessive, the wear resistance is rapidly reduced. Thus, the amount of the Co may be in a range of 4 wt % to 10 wt %.

EXAMPLE 1

As a base material of a cutting tool according to Example 1 of the invention, 83 wt % of WC powder, 8 wt % of Co powder, 3 wt % of Ti carbonitride powder, and 6 wt % of niobium (Nb) carbide powder were weighed and mixed, and a cemented carbide was then manufactured by a sintering process.

The sintering process was performed in such a manner that a dewaxing process was performed by heat-treating at a low temperature of 250° C. for 2 hours, preliminary sintering was performed at 1,200° C. for 1 hour, main sintering was performed at 1,500° C. for 1 hour, cooling was performed at a cooling rate of 13.3° C./min from 1,500° C. to 1,100° C. under a vacuum pressure of 6 mbar, and natural cooling to room temperature was then performed.

In general, during the cooling from 1,500° C. to 1,100° C., since denitrification occurred, other carbides moved into the base material to form a CFL. Solidification proceeded from a surface at a temperature of 1,100° C. or more, and differences in thickness of the CFL and size of a Co structure occurred depending on the degree to which the carbides moved.

In Example 1 of the invention, the cooling rate to 1,100° C., as a solidification completion point after the main sintering, was controlled to be fast and the vacuum pressure was simultaneously controlled so as to increase uniformity of the Co structure formed in the CFL.

A hard film having a multilayer structure was formed by sequentially stacking a 2.5 μm thick TiN layer, a 7 μm thick MT-TiCN layer, a 6 μm thick $\alpha$-$Al_2O_3$ layer, and a 1.5 μm thick TiN layer on a surface of an insert, which was prepared by using the cemented carbide thus manufactured as a base material, by a chemical vapor deposition (CVD) method.

EXAMPLE 2

As a base material of a cutting tool according to Example 2 of the invention, 87.5 wt % of WC powder, 6.5 wt % of Co powder, 1.8 wt % of Ti carbonitride powder, and 4.2 wt % of Nb carbide powder were weighed and mixed, and a cemented carbide was then manufactured under the same sintering conditions as in Example 1.

The same hard film as that of Example 1 of the invention was formed on a surface of an insert prepared by using the cemented carbide thus manufactured as a base material.

EXAMPLE 3

As a base material of a cutting tool according to Example 3 of the invention, 78.8 wt % of WC powder, 5 wt % of Co powder, 1.2 wt % of Ti carbonitride powder, 6.8 wt % of tantalum (Ta) carbide powder, and 8.2 wt % of Nb carbide powder were weighed and mixed, and a cemented carbide was then manufactured under the same sintering conditions as in Example 1.

The same hard film as that of Example 1 of the invention was formed on a surface of an insert prepared by using the cemented carbide thus manufactured as a base material.

COMPARATIVE EXAMPLE 1

As a base material of a cutting tool according to Comparative Example 1, 83 wt % of WC powder, 8 wt % of Co powder, 3 wt % of Ti carbonitride powder, and 6 wt % of Nb carbide powder were weighed and mixed as in the same manner as in Example 1, and a cemented carbide was then manufactured by a sintering process.

The sintering process was performed in such a manner that a dewaxing process was performed by heat-treating at a low temperature of 250° C. for 2 hours, preliminary sintering was performed at 1,200° C. for 1 hour, main sintering was performed at 1,500° C. for 1 hour, cooling was performed at a cooling rate of 3.3° C./min from 1,500° C. to 1,100° C. under a vacuum pressure of 4 mbar, and natural cooling to room temperature was then performed.

That is, when compared with Example 1, Comparative Example 1 was the cemented carbide manufactured under different cooling conditions from 1,500° C. to 1,100° C.

The same hard film as that of Example 1 of the invention was formed on a surface of an insert prepared by using the cemented carbide thus manufactured as a base material.

COMPARATIVE EXAMPLE 2

As a base material of a cutting tool according to Comparative Example 2, 87.5 wt % of WC powder, 6.5 wt % of Co powder, 1.8 wt % of Ti carbonitride powder, and 4.2 wt % of Nb carbide powder were weighed and mixed, and a cemented carbide was then manufactured under the same sintering conditions as in Comparative Example 1.

The same hard film as that of Example 1 of the invention was formed on a surface of an insert prepared by using the cemented carbide thus manufactured as a base material.

COMPARATIVE EXAMPLE 3

As a base material of a cutting tool according to Comparative Example 3, 78.8 wt % of WC powder, 5 wt % of Co powder, 1.2 wt % of Ti carbonitride powder, 6.8 wt % of Ta carbide powder, and 8.2 wt % of Nb carbide powder were weighed and mixed, and a cemented carbide was then manufactured under the same sintering conditions as in Comparative Example 1.

The same hard film as that of Example 1 of the invention was formed on a surface of an insert prepared by using the cemented carbide thus manufactured as a base material.

Microstructure

FIG. 1 is a micrograph of the cemented carbide according to Example 2 of the invention. As illustrated in FIG. 1, other carbide particles having a light gray color were observed at a predetermined depth of the cemented carbide, and a CFL, in which the other carbide particles were not observed, was formed above the other carbide particles.

The Co structure was a structure having a color close to black which was formed in the "upper portion of the CFL" on a surface side based on the center of the CFL and the "lower portion of the CFL", wherein, with respect to the cemented carbide according to Example 2 of the invention, an irregularly formed coarse Co structure was hardly observed in the lower portion of the CFL.

FIG. 2 is a micrograph of the cemented carbide according to Comparative Example 2 of the invention. As illustrated in FIG. 2, with respect to the cemented carbide according to Comparative Example 2, a Co structure formed in the lower portion of the CFL, which is coarser than a Co structure formed in the upper portion of the CFL, was partially observed.

A thickness of the CFL measured in each of the cemented carbides manufactured according to Examples 1 to 3 of the invention and Comparative Examples 1 to 3 and the results of measuring a ratio of a maximum size of the lower Co structure to a maximum size of the upper Co structure from each micrograph using an image analyzer are presented in Table 1 below.

TABLE 1

| Sample | Thickness of CFL (μm) | Size of Co structure (lower portion/upper portion) |
|---|---|---|
| Example 1 | 32 | 1.2 |
| Example 2 | 25 | 1.2 |
| Example 3 | 14 | 1.3 |
| Comparative Example 1 | 32 | 4 |
| Comparative Example 2 | 25 | 3.4 |
| Comparative Example 3 | 14 | 2.1 |

As illustrated in Table 1, the thicknesses of the CFLs of Example 1 and Comparative Example 1, in which the amount of Co was large, were formed to be large at 32 microns. In contrast, the thicknesses of the CFLs of Example 2 and Comparative Example 2, in which the amount of Co was intermediate, were 25 μm, and the thicknesses of the CFLs of Example 3 and Comparative Example 3, in which the amount of Co was the smallest, were 14 μm.

The ratio of the maximum size of the lower Co structure to the maximum size of the upper Co structure formed in the CFL in each of the cemented carbides according to Examples 1 to 3 of the invention was low in a range of 1.2 to 1.3, but the ratio of the maximum size of the lower Co structure to the maximum size of the upper Co structure formed in the CFL in each of the cemented carbides according to Comparative Examples 1 to 3 was in a range of 2.1 to 4 which was greater than two times the above ratio in each of the cemented carbides according to Examples 1 to 3.

This indicated that an irregularly formed coarse Co structure was formed in the lower portion of the CFL of each of Comparative Examples 1 to 3.

Results of Machining Performance Evaluation

In order to investigate effects of the above-described difference in the Co structure on machining performance, machining performance tests for wear resistance and impact resistance of each cutting tool were performed under the following two conditions.

(1) Alloy Steel Wear Resistance Machining Condition

Machining Method: turning (continuous machining of outer diameter)

Workpiece: SCM440

Vc (machining speed): 280 mm/min fn (feed rate): 0.25 mm/min ap (depth of cut): 2 mm dry/wet: wet (2) Carbon Steel Impact Resistance Machining Condition Machining Method: turning (interrupted machining of outer diameter)

Workpiece: SM45C-V groove

Vc (machining speed): 300 mm/min fn (feed rate): 0.3 mm/min ap (depth of cut): 2 mm dry/wet: wet The results of the machining performance tests performed under the above-described conditions are presented in Table 2 below.

TABLE 2

| Sample | CFL thickness (μm) | Ratio of sizes of Co structures (lower portion/upper portion) | Alloy steel wear resistance | Carbon steel impact resistance |
|---|---|---|---|---|
| Example 1 | 32 | 1.2 | 1,370 mm | 360 mm |
| Example 2 | 25 | 1.2 | 1,650 mm | 260 mm |
| Example 3 | 14 | 1.3 | 1,980 mm | 180 mm |
| Comparative Example 1 | 32 | 4 | 1,150 mm | 270 mm |
| Comparative Example 2 | 25 | 3.4 | 1,400 mm | 150 mm |
| Comparative Example 3 | 14 | 2.1 | 1,740 mm | 100 mm |

As illustrated in Table 2, the results of the machining performance tests for wear resistance of the steel showed a general trend that the wear resistance was improved and the impact resistance was reduced as the amount of Co in the cemented carbide was reduced.

When Example 1 and Comparative Example 1 having the same thickness of the CFL were compared with respect to the evaluation results of wear resistance, Example 1 was 1,370 mm, but Comparative Example 1 was low at 1,150 mm. With respect to the evaluation results of impact resistance, Example 1 was 360 mm, but Comparative Example 1 was 270 mm. Thus, Comparative Example 1 showed significantly degraded characteristics in comparison to Example 1.

Also, when Example 2 and Comparative Example 2 having the same thickness of the CFL were compared with respect to the evaluation results of wear resistance, Example 2 was 1,650 mm, but Comparative Example 2 was low at 1,400 mm. With respect to the evaluation results of impact resistance, Example 2 was 260 mm, but Comparative Example 2 was low at 150 mm.

Furthermore, when Example 3 and Comparative Example 3 having the same thickness of the CFL were compared with respect to the evaluation results of wear resistance, Example 3 was 1,980 mm, but Comparative Example 3 was low at 1,740 mm. With respect to the evaluation results of impact resistance, Example 3 was 180 mm, but Comparative Example 3 was very low at 100 mm.

Form the above results, it was confirmed that, if the cemented carbides had the same thickness of the CFL, the cemented carbide having the Co structure according to the embodiment of the invention may have improved wear resistance and impact resistance in comparison to the cemented carbide which did not have the Co structure according to the embodiment of the invention.

The invention claimed is:

1. A cemented carbide comprising:

1.5 wt % to 20 wt % of carbide or carbonitride including at least one of tantalum (Ta), niobium (Nb), and titanium (Ti);

4 wt % to 10 wt % of cobalt (Co); and a tungsten carbide (WC) as well as unavoidable impurities as a remainder, wherein a cubic phase free layer (CFL), in which the carbide or the carbonitride is not formed, is formed from a surface of the cemented carbide to a depth of 5 μm to 50 μm, wherein, an upper portion of the CFL is defined from a center of the CFL to a surface of the CFL, a lower portion of the CFL is defined from the center of the CFL to a boundary of a bottom of a base material, a size of the Co structure is defined as a length of a major axis of a Co structure, in which a ratio of the length of the major axis of the Co structure formed in the CFL to a length of a minor axis thereof is 5 or less, and a size of the largest Co structure in the lower portion of the CFL is 1.3 times or less a size of the largest Co structure in the upper portion of the CFL.

2. The cemented carbide of claim 1, wherein a thickness of the CFL is in a range of 10 μm to 30 μm.

* * * * *